US006544644B1

(12) United States Patent
Bouquerel et al.

(10) Patent No.: US 6,544,644 B1
(45) Date of Patent: Apr. 8, 2003

(54) ABRASION RESISTANT SPUN ARTICLES

(75) Inventors: Franck Bouquerel, Lyons (FR); Joël Varlet, Lyons (FR); Jean-Pierre Marchand, Lyons (FR)

(73) Assignee: Rhodianyl, Courbevoie Cedex (FR)

( * ) Notice: Subject to any disclaimer, the term of this patent is extended or adjusted under 35 U.S.C. 154(b) by 0 days.

(21) Appl. No.: 09/786,401

(22) PCT Filed: Jul. 5, 2000

(86) PCT No.: PCT/FR00/01933

§ 371 (c)(1),
(2), (4) Date: Jun. 4, 2001

(87) PCT Pub. No.: WO01/02629

PCT Pub. Date: Jan. 11, 2001

(30) Foreign Application Priority Data

Jul. 6, 1999 (FR) ..... 99 08975

(51) Int. Cl.[7] ..... D01F 6/00
(52) U.S. Cl. ..... 428/364; 428/372; 428/395
(58) Field of Search ..... 428/364, 395, 428/372

(56) References Cited

U.S. PATENT DOCUMENTS

| | | | | | |
|---|---|---|---|---|---|
| 2,819,173 | A | | 1/1958 | Dithmar | 106/166 |
| 4,739,007 | A | | 4/1988 | Okada et al. | 524/789 |
| 5,102,948 | A | | 4/1992 | Deguchi et al. | 524/789 |
| 5,234,644 | A | | 8/1993 | Schütze et al. | 264/101 |
| 5,385,776 | A | * | 1/1995 | Maxfield et al. | 428/239 |
| 6,066,305 | A | * | 5/2000 | Dugger | 423/263 |
| 6,103,805 | A | * | 8/2000 | Kojima et al. | 524/442 |
| 6,156,838 | A | * | 12/2000 | Yashikawa et al. | 524/789 |
| 6,162,530 | A | * | 12/2000 | Xia et al. | 428/292.1 |
| 6,300,419 | B1 | * | 10/2001 | Sehanobish et al. | 525/191 |
| 6,323,270 | B1 | * | 11/2001 | Ishida | 524/445 |
| 6,454,819 | B1 | * | 9/2002 | Yano et al. | 51/298 |

FOREIGN PATENT DOCUMENTS

| | | |
|---|---|---|
| EP | 0398551 | 11/1990 |
| GB | 759374 | 10/1956 |
| JP | 03 081364 | 4/1991 |
| JP | 07 331591 | 12/1995 |

* cited by examiner

*Primary Examiner*—N. Edwards
(74) *Attorney, Agent, or Firm*—Burns, Doane, Swecker & Mathis, L.L.P.

(57) ABSTRACT

The invention relates to spun articles, threads (yarns), fibers or filaments which have improved abrasion resistance properties and which can be used to produce felts for paper machines. The invention more specifically relates to synthetic resin-based threads (yarns), fibers or filaments having nanometric-sized loads.

7 Claims, No Drawings

ABRASION RESISTANT SPUN ARTICLES

The present invention relates to spun articles, yarns, fibers or filaments which have improved abrasion resistance and which can be used in particular to produce felts for paper machines. The invention relates more particularly to yarns, fibers or filaments based on synthetic resin and containing nanometric-sized fillers.

The properties which spun articles need to have are different depending on their use. Among these, mention may be made, for example, of mechanical strength, transparency, gloss, whiteness, dyeing ability, shrinkage, capacity for water retention, fire resistance, stability and heat resistance. One property which may be demanded, in particular for applications in industrial fields or the fields of so-called technical yarn, is abrasion resistance.

This is the case, for example, for the manufacture of nonwoven felts from fibers. Increasing the abrasion resistance generally makes it possible to increase the lifetime of the articles manufactured from yarns, fibers or filaments. In the case of felts for paper machines, which are made from synthetic fibers, this property has become critical following the replacement of chemical bleaching agents with solid particles, for example calcium carbonate.

This is also the case, for example, for the manufacture of rugs and carpets from fibers. In this case, the mechanical rubbing or abrasion stresses on the rug or carpet are such that the abrasion resistance property directly characterizes the lifetime of the rug or carpet.

One known solution for improving the abrasion resistance of spun articles is to increase the degree of curing of the synthetic material from which they are made. This is the way in which fibers made from thermoplastic resins of increasingly high viscosity are developed. U.S. Pat. No. 5,234,644 discloses, for example, a process for increasing the viscosity of polymers. However, this solution has limits. Specifically, the spinning of fibers of very high viscosity requires the use of very high spinning pressures and/or very high spinning temperatures, which may result in degradation of the polymer.

Another solution for improving the abrasion resistance of articles made from fibers consists in using articles with three-dimensional crimping.

The aim of the present invention is to propose another solution for obtaining spun articles with high abrasion resistance.

To this end, the invention proposes yarns, fibers and filaments based on synthetic resin, characterized in that they comprise between 0.05% and 20% by weight of nanometric-sized particles dispersed in-the resin and in that they have an abrasion resistance which is improved by at least 5% compared with yarns, fibers and filaments made from an identical resin, of the same viscosity but not containing nanometric-sized particles. The abrasion resistance is defined by the number of to and fro motions of a three-roll roller assembly, over a set of 15 fixed yarns, that is required to break 13 of the yarns.

This solution furthermore has the advantage of being able to be combined with an improvement in the abrasion resistance by increasing the viscosity of the resin.

The expression "nanometric-sized particle" means any object for which at least one characteristic size parameter (diameter, length, thickness) is less than or equal to 100 nanometers, preferably less than or equal to 50 nm. The particles may be, for example, substantially spherical, with a nanometric-sized diameter. The particles may be in the shape of platelets or needles, i.e. shapes for which it is possible to define at least one large size parameter and at least one small size parameter. In this case, the small size parameter is advantageously less than 50 nm and preferably 10 nm. For example, the particles may be platelets less than 10 nm thick with a form factor, i.e. a ratio of large size to small size, of greater than 10.

The weight proportion of the particles relative to the total weight of the material is between 0.05% and 20%. It is advantageously less than or equal to 5%.

The synthetic resin constituting the matrix in which the particles are dispersed may be chosen from any spinnable polymer. It consists, for example, of polyamide or polyester, a blend of polymers comprising polyamide or polyester, or copolymers based on polyamide or polyester. As examples of polyamides which are suitable for carrying out the invention, mention may be made in particular of Nylon-6 and Nylon-6,6, and blends and copolymers thereof.

The yarns, fibers and filaments according to the invention may contain any additive usually used with such polymers, for example heat stabilizers, UV stabilizers, catalysts, pigments, dyes and antibacterial agents.

According to a first embodiment of the invention, the particles dispersed in the synthetic resin matrix are of substantially spherical shape with a mean diameter of less than or equal to 100 nanometers. According to one preferred embodiment, the mean diameter of these particles is less than or equal to 50 nanometers.

The particles may be chosen from particles based on inorganic materials. They may be metallic or mineral, obtained from a natural source or may be synthesized. Examples of suitable materials which may be mentioned include silver, copper, gold and the oxides and sulfides of metals, for example of silicon, zirconium, titanium, cadmium or zinc. Silica-based particles may be used in particular.

The particles may have been subjected to treatments to make them compatible with the matrix. These treatments are, for example, surface treatments or a surface deposition of a compound other than that constituting the core of the particles. Treatments and depositions may similarly be carried out in order to promote the dispersion of the particles, either in the polymerization medium of the matrix or in the molten polymer.

The surface of the particles may comprise a protective layer intended to prevent any degradation of the polymer in contact with these particles. Metal oxides, for example silica, in a continuous or discontinuous layer, may thus be deposited at the surface of the particles.

Any method for obtaining a dispersion of particles in a resin may be used to carry out the invention. A first process consists in melt-blending the particles in resin and in optionally subjecting the mixture to high shear, for example in a twin-screw extrusion device, in order to achieve good dispersion. Another process consists in mixing the particles with the monomers in the curing medium, and then in curing the resin. Another process consists in melt-blending a concentrated mixture of a resin and particles, prepared, for example, according to one of the processes described above.

There is no limitation on the form in which the particles are introduced and mixed with the monomers or the melt. The particles may be introduced in the form of powder or in the form of an optionally stablilized aqueous solution. For example, a silica sol may be introduced into the curing medium of the resin.

According to a second embodiment of the resin, the particles dispersed in the synthetic resin matrix are in the form of platelets less than 10 nanometers thick. Preferably, the thickness is less than 5 nanometers. The particles are preferably dispersed in the matrix in individual form. However, aggregates may exist and are preferably less than 100 nm thick and even more preferably less than 50 nm thick.

The platelets are advantageously obtained from exfoliable silicate leaflets. The exfoliation may be promoted by a prior treatment with a swelling agent, for example by exchange of the cations initially contained in the silicates with organic cations such as oniums. The organic cations may be chosen from phosphoniums and ammoniums, for example primary to quaternary ammoniums. Mention may be made, for example, of protonated amino acids such as 12-aminododecanoic acid, protonated primary to tertiary ammoniums, and quaternary ammoniums. The chains attached to the nitrogen or phosphorus atom of the onium may be aliphatic, aromatic, aryaliphatic, linear or branched and may contain oxygenated units, for example hydroxyl or ethoxy units. As examples of organic ammonium treatments, mention may be made of dodecylammonium, octadecylammonium, bis(2-hydroxyethyl) octadecylmethylammonium, dimethyldioctadecylammonium, octadecylbenzyldimethylammonium and tetramethylammonium. As examples of organic phosphonium treatments, mention may be made of alkylphosphoniums such as tetrabutylphosphonium, trioctyloctadecylphosphonium and octadecyltriphenylphosphonium. These lists do not have any limiting nature.

The silicate leaflets which are suitable for carrying out the invention may be chosen from montmorillonites, smectites, illites, sepiolites, palygorkites, muscovites, allervardites, amesites, hectorites, talcs, fluorohectorites, saponites, beidellites, nontronites, stevensites, bentonites, micas, fluoromicas, vermiculites, fluorovermiculites and halloysites. These compounds may be of natural, synthetic or modified natural origin.

According to one preferred embodiment of the invention, the yarns, fibers and filaments are composed of polyamide resin and of platelet particles dispersed in the resin, obtained by exfoliation of a phyllosilicate, for example a montmorillonite which has undergone a prior swelling treatment by ion exchange. Examples of swelling treatments which may be used are disclosed, for example, in patent EP-A-0 398 551. All the known treatments for promoting the exfoliation of phyllosilicates in a polymer matrix may be used. It is possible, for example, to use a clay treated with an organic compound sold by the company Laporte under the brand name Cloisite®.

Any method for obtaining a dispersion of particles in a resin may be used to carry out the invention. A first process consists in mixing the compound to be dispersed, optionally treated, for example, with a swelling agent, in the melt and in optionally subjecting the mixture to high shear, for example in a twin-screw extrusion device, in order to achieve good dispersion. Another process consists in mixing the compound to be dispersed, optionally treated, for example, with a swelling agent, with the monomers in the curing medium, and then in curing the resin. Another process consists in melt-blending a concentrated mixture of a resin and dispersed particles, prepared, for example, according to one of the processes described above.

There is no limitation on the form in which the particles are introduced and mixed with the monomers or the melt. The particles may be introduced in the form of a powder of exfoliable compound or in the form of a dispersion in water or in an organic dispersant of an exfoliable compound.

The spun articles, yarns, fibers or filaments are made according to the usual spinning techniques from a material comprising the synthetic resin and the particles. The spinning may be carried out immediately after curing the resin, this resin being in molten form. It may be carried out using a granular composite comprising the particles and the synthetic resin. The particles may be incorporated into the molten polymer before the spinning operation, in the form of a concentrated mixture in a polymer. Any method for incorporating particles into a polymer to be spun may be used.

The spun articles according to the invention may be subjected to any treatment which may be carried out in steps subsequent to the spinning step. They may in particular be drawn, textured, crimped, heated, twisted, dyed, sized, chopped, etc. These additional operations may be carried out continuously and may be incorporated after the spinning device or may be carried out in batchwise mode. The list of operations subsequent to the spinning operation has no limiting nature.

The spun articles according to the invention may be used in woven, knitted or nonwoven form. The fibers according to the invention are suitable in particular for the manufacture of felts for paper machines. They may also be used for the manufacture of yarns for carpets.

Other details or advantages of the invention will emerge more clearly in the light of the example below, which is given purely as a guide.

The properties and characteristics of the yarns according to the invention are determined according to the following methods:

Mechanical characterization (elongation at break, tensile strength): carried out on an Erichsen tensile machine placed in an air-conditioned location at 50% RH and 23° C. after conditioning the yarns for 72 hours under these conditions. The initial length of the yarns is 50 mm and the traveling speed is 50 mm/min.

Abrasion resistance: a simultaneous friction is applied to 15 immobile yarns whose tension is kept constant at 15 yarns by 3 brass rolls forming a roller assembly. The point of application of the rolling zone is moved along the yarns over an amplitude of 90 mm at a frequency of 220 cycles per minute. The abrasion resistance is defined by the number of cycles (to and fro) required to break 13 of the 15 yarns. The measurements given are the averages of the values obtained on three tests with similar yarns.

EXAMPLES 1 AND 2

A sol of silica nanospheres of the brand name Klebosol® with a mean diameter equal to 50 nm, sold by the company Hoechst, is introduced into caprolactam. The sol is introduced as an aqueous phase at a weight concentration of 30%.

The curing of the caprolactam is carried out according to a usual process. After curing, a polymer is obtained with an absolute molar mass of 34 980 g/mol, determined by GC, and a viscosity index of 140 ml/g. The polymer is washed and then dried for 16 hours at 110° C. under a primary vacuum.

The polymer is then spun at low speed in the form of a round monofilament through a die about 1 mm in diameter. The yarn obtained has a diameter of about 250 $\mu$m. The yarn is then drawn by pinching between two rollers. The draw ratio is equal to the ratio of the rotation speeds of the rollers. Different draw ratios are applied.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 1 | 4.37 | 28.8 | 752 | 2.44 | 1875 |
| Example 2. | 5.04 | 21.9 | 868 | 3.04 | 1375 |

EXAMPLES 3 AND 4

5% by weight of a clay treated with an organic compound sold by the company Laporte under the name Cloisite 25A, a sodium montmorillonite which has undergone an ion exchange with dimethyl-2-ethylhexyl-(hydrogenated tallow)ammonium methyl sulfate, of 95 to 100 milliequivalents per 100 g of montmorillonite, is introduced into Nylon-6. Nylon-6 is a commercial compound with a viscosity index of 140 ml/g, sold under the name Technyl®. The incorporation is carried out in a Leistritz twin-screw extruder with a diameter of 34 mm.

The compound obtained is spun and drawn under the same conditions as those described in Examples 1 and 2.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 3 | 4.28 | 27.4 | 491 | 4.68 | 5200 |
| Example 4 | 5.02 | 19.3 | 777 | 6.51 | 3800 |

EXAMPLES 5 AND 6

3% by weight of a clay treated with an organic compound sold by the company Laporte under the name Cloisite 25A, a sodium montmorillonite which has undergone an ion exchange with dimethyl-2-ethylhexyl-(hydrogenated tallow)ammonium methyl sulfate, of 95 to 100 milliequivalents per 100 g of montmorillonite, is introduced into Nylon-6. Nylon-6 is a commercial compound with a viscosity index of 140 ml/g, sold under the name Technyl®. The incorporation is carried out in a Leistritz twin-screw extruder with a diameter of 34 mm.

The compound obtained is spun and drawn under the same conditions as those described in Examples 1 and 2.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 5 | 4.10 | 30.0 | 519 | 3.58 | 6300 |
| Example 6 | 4.65 | 19.6 | 625 | 4.21 | 5500 |

EXAMPLES 7 AND 8

1% by weight of a clay treated with an organic compound sold by the company Laporte under the name Cloisite 25A, a sodium montmorillonite which has undergone an ion exchange with dimethyl-2-ethylhexyl-(hydrogenated tallow)ammonium methyl sulfate, of 95 to 100 milliequivalents per 100 g of montmorillonite, is introduced into Nylon-6. Nylon-6 is a commercial compound with a viscosity index of 140 ml/g, sold under the name Technyl®. The incorporation is carried out in a Leistritz twin-screw extruder with a diameter of 34 mm.

The compound obtained is spun and drawn under the same conditions as those described in Examples 1 and 2.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 7 | 4.15 | 31.0 | 563 | 3.84 | 6400 |
| Example 8 | 4.78 | 24.3 | 685 | 4.57 | 4400 |

EXAMPLES 9 AND 10

5% by weight of a clay treated with an organic compound sold by the company Laporte, a sodium montmorillonite which has undergone an ion exchange with dimethyldioctadecylammonium chloride, of 120 milliequivalents per 100 g of montmorillonite, is introduced into Nylon-6. Nylon-6 is a commercial compound with a viscosity index of 140 ml/g, sold under the name Technyl®. The incorporation is carried out in a Leistritz twin-screw extruder with a diameter of 34 mm.

The compound obtained is spun and drawn under the same conditions as those described in Examples 1 and 2.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 9 | 4.62 | 23.8 | 528 | 2.66 | 2300 |
| Example 10 | 5.33 | 17.0 | 650 | 4.28 | 1575 |

EXAMPLES 11 AND 12

5% by weight of a clay treated with an organic compound sold by the company Laporte, a sodium montmorillonite which has undergone an ion exchange with methyl-N,N-bis (hydroxyethyl)(ester of hydrogenated 2-hydroxyethyl tallow)ammonium methyl sulfate, of 95 to 120 milliequivalents per 100 g of montmorillonite, is introduced into Nylon-6,6. Nylon-6,6 is a commercial compound with a viscosity index of 140 ml/g, sold by the company Nyltech. The incorporation is carried out in a Leistritz twin-screw extruder with a diameter of 34 mm.

The compound obtained is spun and drawn under the same conditions as those described in Examples 1 and 2.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Example 11 | 3.94 | 25.0 | 372 | 3.7 | 5200 |
| Example 12 | 4.72 | 17.1 | 501 | 4.7 | 4200 |

COMPARATIVE EXAMPLES 1 AND 2

A Nylon-6 with a viscosity of 140 ml/g is spun and drawn under the same conditions as those described in Examples 3 to 10.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Comparative Example 1 | 4.34 | 33.7 | 660 | 3.72 | 1700 |
| Comparative Example 2 | 5.16 | 20.0 | 975 | 5.74 | 1000 |

COMPARATIVE EXAMPLES 3 AND 4

A Nylon-6,6 with a viscosity index of 140 ml/g is spun and drawn under the same conditions as those described in Examples 11 and 12.

The characteristics of the yarns obtained are as follows:

| | Draw ratio | Elongation at break (%) | Tensile strength (MPa) | 5% Secant modulus (MPa) | Abrasion resistance (cycles) |
|---|---|---|---|---|---|
| Comparative Example 3 | 4.09 | 37.5 | 480 | 3.3 | 5050 |
| Comparative Example 4 | 4.85 | 22.2 | 672 | 4.2 | 3000 |

What is claimed is:

1. A fiber or filament based on a synthetic resin, comprising between 0.05% and 20% by weight of nanometric-sized particles dispersed in the resin and having an abrasion resistance which is improved by at least 5% compared with a fiber or filament made from an identical resin, of the same viscosity but not comprising nanometric-sized articles;

wherein the nanometric-sized particles are of substantially spherical shape and have a mean diameter of less than or equal to 100 nanometers; and wherein the nanometric-sized particles are inorganic particles based on oxides or sulfides of titanium, silicon, zirconium, cadmium or zinc or a mixture thereof.

2. A fiber or filament based on a synthetic resin, comprising between 0.05% and 20% by weight of nanometric-sized particles dispersed in the resin and having an abrasion resistance which is improved by at least 5% compared with a yarn, fiber or filament made from an identical resin, of the same viscosity but not comprising nanometric-sized articles, the synthetic resin being selected from the group consisting of a polyamide, a blend containing polyamides and a copolymer based on polyamides;

wherein the nanometric-sized particles are of substantially spherical shape and have a mean diameter of less than or equal to 100 nanometers; and wherein the nanometric-sized particles are inorganic particles based on oxides or sulfides of titanium, silicon, zirconium, cadmium or zinc or a mixture thereof.

3. The fiber or filament as claimed in claim 2, wherein the mean diameter of nanometric-sized particles is less than or equal to 50 nanometers.

4. The fiber or filament as claimed in claim 1, wherein the nanometric-sized particles are based on silica.

5. The fiber or filament as claimed in claim 2, wherein the nanometric-sized particles are based on silica.

6. The fiber or filament as claimed in claim 4, wherein the silica-based particles are introduced in the form of a sol into a medium for polymerizing the resin.

7. The fiber or filament as claimed in claim 5, wherein the silica-based particles are introduced in the form of a sol into a medium for polymerizing the resin.

* * * * *